US012352003B1

(12) United States Patent
Li et al.

(10) Patent No.: US 12,352,003 B1
(45) Date of Patent: Jul. 8, 2025

(54) WHOLE-SPACE DRILLING-GROUTING INTEGRATED DEVICE

(71) Applicants: SHANDONG UNIVERSITY, Jinan (CN); SHAANXI XITAN GEOLOGICAL EQUIPMENT CO., LTD., Xi'an (CN)

(72) Inventors: Shucai Li, Jinan (CN); Mengtian Li, Jinan (CN); Shuaixun Luo, Xi'an (CN); Chunjin Lin, Jinan (CN); Zhaohui Dong, Xi'an (CN); Jianbo Zhao, Xi'an (CN); Lei Yang, Jinan (CN); Hanpeng Wang, Jinan (CN); Zhaofeng Li, Jinan (CN); Shaoshuai Shi, Jinan (CN)

(73) Assignees: SHANDONG UNIVERSITY, Jinan (CN); SHAANXI XITAN GEOLOGICAL EQUIPMENT, Xi'an (CN)

( * ) Notice: Subject to any disclaimer, the term of this patent is extended or adjusted under 35 U.S.C. 154(b) by 0 days.

(21) Appl. No.: 18/965,106

(22) Filed: Dec. 2, 2024

(30) Foreign Application Priority Data

Feb. 27, 2024 (CN) ..... 202410214518.9

(51) Int. Cl.
*E02D 3/12* (2006.01)
*E02D 5/46* (2006.01)

(52) U.S. Cl.
CPC ..... *E02D 3/126* (2013.01); *E02D 5/46* (2013.01)

(58) Field of Classification Search
CPC .. E02D 3/126; E02D 3/12; E02D 5/46; E21D 20/003; E21D 20/02
See application file for complete search history.

(56) References Cited

U.S. PATENT DOCUMENTS

2011/0110727 A1* 5/2011 Plahert ..... E02D 3/12 405/269

FOREIGN PATENT DOCUMENTS

CN 104314466 A 1/2015
CN 106351225 A 1/2017
(Continued)

OTHER PUBLICATIONS

Aug. 14, 2024 Office Action issued in Chinese Patent Application No. 202410214518.9.

(Continued)

*Primary Examiner* — Sean D Andrish
(74) *Attorney, Agent, or Firm* — Oliff PLC

(57) ABSTRACT

The present invention provides a whole-space drilling-grouting integrated device, comprising: a traveling mechanism comprising a drilling-grouting mechanism of which one side is provided with a rod-changing robotic arm and comprising an adjusting mechanism; the adjusting mechanism is connected to a platform that connected to a supporting platform through a drilling-moving mechanism; an output shaft of a power mechanism fixed on the supporting platform is detachably connected with a drilling tool; a first drilling tool clamping mechanism arranged at tail end of the platform is connected to arc-shaped guide rail arranged on the platform in a sliding way and is further connected to rotating driving member of the platform so as to realize rotation around an axis of output shaft of the power mechanism; and, a second drilling tool clamping mechanism fixedly connected to tail end of the platform where far away from power head.

10 Claims, 9 Drawing Sheets

(56) References Cited

FOREIGN PATENT DOCUMENTS

| | | | | |
|---|---|---|---|---|
| CN | 106836185 | A | | 6/2017 |
| CN | 107059876 | | * | 8/2017 |
| CN | 111501741 | A | | 8/2020 |
| CN | 112554785 | A | | 3/2021 |
| CN | 113266406 | A | | 8/2021 |
| CN | 215485885 | U | | 1/2022 |
| CN | 114960632 | A | | 8/2022 |
| CN | 116411973 | A | | 7/2023 |
| CN | 117231116 | A | | 12/2023 |
| CN | 118110428 | A | | 5/2024 |
| WO | 2022/017048 | A1 | | 1/2022 |

OTHER PUBLICATIONS

Sep. 14, 2024 Office Action issued in Chinese Patent Application No. 202410214518.9.

* cited by examiner

WHOLE-SPACE DRILLING-GROUTING INTEGRATED DEVICE

TECHNICAL FIELD

The present invention relates to the technical field of geotechnical engineering construction equipment, in particular to a whole-space drilling-grouting integrated device.

BACKGROUND

The statements in this section merely provide background information related to the present invention and are not necessarily prior art.

Grouting is the main technical means for controlling water-rich fracture fault disaster in tunnel engineering. Chinese Patent Application Pub. No. CN114960632A discloses a horizontal drilling rotary jet grouting pile-forming device and construction method thereof, which comprises a traveling mechanism, an azimuth angle adjusting mechanism, a height elevation angle adjusting mechanism and a rotary jet grouting mechanism. The rotary jet grouting mechanism comprises a sliding frame, a front power head, a wall protection sleeve, a rear power head, a drill rod and a drill bit. The sliding frame is connected with a front power head and a rear power head. The front power head is detachably connected with the wall protection sleeve and used for driving the wall protection sleeve to move in the front-back direction. The rear power head is detachably connected with one end of the drill rod, the rear power head is used for driving the drill rod to rotate and move in the front-back direction, and the drill rod and the wall protection sleeve are coaxially arranged. Another end of the drill rod is detachably connected with the drill bit or a grouting bit. The inventor finds that the grouting pile-forming device has the following defects:

1. It can only realize horizontal drilling and grouting for pile formation, which cannot realize multi-pitch angle rotary grouting operation;
2. It is difficult to achieve stable support by using ground layer in arbitrary terrain space, therefore its adaptability to terrain is poor; and
3. Manual assistance is needed when the drilling tool of the device is disassembled or lengthened, so the labor intensity of the construction personnel is high, the construction efficiency is low, and there are certain safety hazards for the construction personnel.

SUMMARY

Aiming at the defects existing in the prior art, the present invention aims to provide a whole-space drilling-grouting integrated device, which can realize grouting reinforcement with a plurality of functions at a plurality of angles in whole-space, can realize automatic replacement and extension of a drilling tool, reduces labor intensity of construction personnel and improves work efficiency.

In order to achieve the above object, the present invention is realized through the following technical solutions.

One embodiment of the present invention provides a whole-space drilling-grouting integrated device, comprising: a traveling mechanism, wherein the traveling mechanism is provided with a drilling-grouting mechanism; one side of the drilling-grouting mechanism is provided with a rod-changing robotic arm; the drilling-grouting mechanism comprises an adjusting mechanism; the adjusting mechanism is connected to a platform; the platform is connected to a supporting platform through a drilling-moving mechanism; a power mechanism is fixed on the supporting platform, an output shaft of the power mechanism is detachably connected with a drilling tool; a first drilling tool clamping mechanism and a second drilling tool clamping mechanism are arranged at a tail end of the platform; wherein, the second drilling tool clamping mechanism is arranged far away from a power head, the second drilling tool clamping mechanism is fixedly connected with the platform, the first drilling tool clamping mechanism is connected to an arc-shaped guide rail arranged on the platform in a sliding way, and the first drilling tool clamping mechanism is connected to a rotating driving member of the platform so as to realize rotation around an axis of an output shaft of the power mechanism;

a multi-speed power head, wherein the multi-speed power head comprises a shell, the shell is provided with an input shaft and an output shaft; wherein, one end of the input shaft is rotatably connected to a first input gear, the first input gear is connected with a planetary reduction mechanism, the planetary reduction mechanism is connected to a power assembly, the power assembly drives the first input gear to rotate through the planetary reduction mechanism; the first input gear is meshed with a first output gear, the first output gear is rotatably connected on the output shaft, the first input gear drives the first output gear to rotate, and tooth numbers of the first input gear and the first output gear are configured such that an output motion is a decelerating motion; the input shaft is also fixedly connected to a second input gear, the second input gear is meshed with a second output gear, the second output gear is rotatably connected to the output shaft, the second input gear drives the second output gear to rotate, and tooth numbers of the second input gear and the second output gear are configured such that an output motion is a decelerating motion; a first clutch wheel is connected to the output shaft through a key, and moves along an axis direction of the output shaft while rotating synchronously with the output shaft; the input shaft is also rotatably connected to a third input gear, the third input gear is meshed with a third output gear, the third output gear is fixed to the output shaft, and tooth numbers of the third input gear and the third output gear are configured such that an output motion is an accelerated motion; a second clutch wheel is connected to the input shaft through a key, and the second clutch wheel rotates synchronously with the input shaft and moves along an axial direction of the input shaft; wherein the multi-speed power head may provide six different speeds through a cooperation between the first third clutch wheel with the first output gear or the second output gear, a cooperation between the second third clutch wheel with the third output gear, and a parallel or series connection of two hydraulic motors. In the state where the two hydraulic motors are connected in series or parallel, when the multi-speed power head is in a high or low speed, carrying out a drilling and coring of a reinforced concrete lining; when the power head is in a ultra-low speed, carrying out a high-pressure rotary jet grouting; and a drilling tool is further connected to the multi-speed power head, wherein the drilling tool comprises a drill rod, a drill bit is detachably connected to an end part of the drill rod, a grouting channel and a main gas channel are arranged both in the drill rod and the drill bit, a slurry outlet arranged on the drill bit is communicated with the grouting channel, a plurality of main gas ports are arranged on a periphery of the slurry outlet, the plurality of the main gas ports are communicated with the main gas channel in the drill bit; a slurry discharge channel is arranged in both the drill rod and the drill bit, a slurry inlet of the slurry discharge channel extends to a rear part of the drill bit, correspondingly, a slurry discharge inlet is provided on the drill bit for communicating with the slurry discharge channel; further, an auxiliary gas channel is arranged in both the drill rod and the drill bit, an air outlet end of the auxiliary gas channel extends to a rear part of the slurry discharge channel in the drill bit and is communicated with the slurry discharge channel; wherein when a progressive rotary jet grouting method is used, a slurry is jetted out from the slurry outlet to perform the rotary jet grouting; simultaneously, an air curtain is formed by a gas jetted out from the plurality of the main gas ports, cutting a formation together with the jetted slurry, to finally form a cylindrical consolidated body with a grout-soil reinforcement body at a lower part and a loose grout-soil-gas expansion body at an upper part.

Optionally, the first drilling tool clamping mechanism and the second drilling tool clamping mechanism both comprise a frame, wherein the frame is of a U-shaped structure to form a space for the drilling tool to pass through, a pair of clamping driving member is arranged oppositely and is connected to the frame, each of the clamping driving member is connected with a clamping block, the frame of the first drilling tool clamping mechanism is connected with an arc-shaped guide rail in a sliding way, and the frame of the second drilling tool clamping mechanism is fixedly connected with the platform.

Optionally, the rotating driving member is of a rotating driving hydro-cylinder, a cylinder body of the rotating driving hydro-cylinder is hinged with the platform, and a piston rod thereof is hinged with one side of the first drilling tool clamping mechanism, so as to drive the first drilling tool clamping mechanism to rotate through an expansion and contraction of the piston rod.

Optionally, the adjusting mechanism comprises a base, wherein the base is hinged with a bottom end of a pitching arm, a first end of a first pitching adjusting hydro-cylinder is hinged with the base, and a second end of the first pitching adjusting hydro-cylinder is hinged with the pitching arm, a top end of the pitching arm is rotatably connected with a slewing mechanism, the slewing mechanism is connected with the platform, a first end of a second pitching adjusting hydro-cylinder is hinged with the slewing mechanism, and a second end of the second pitching adjusting hydro-cylinder is hinged with the pitching arm.

Optionally, the pitching arm comprises a fixed arm part, a telescopic arm part is slidably connected to the fixed arm part, a first telescopic driving hydro-cylinder is arranged between the fixed arm part and the telescopic arm part, the fixed arm part is hinged with the base, a first pitching adjusting hydro-cylinder is arranged between the fixed arm part and the base, the telescopic arm part is hinged with the slewing mechanism, and a second pitching adjusting hydro-cylinder is arranged between the slewing mechanism and the telescopic arm part.

Optionally, the platform comprises a fixed platform part and a telescopic platform part, wherein the fixed platform part is connected with the slewing mechanism; the telescopic platform part is connected with the fixed platform part in a sliding manner; a second telescopic driving hydro-cylinder is arranged between the telescopic platform part and the fixed platform part; and the telescopic platform part is connected with the supporting platform through a moving mechanism.

Optionally, the power mechanism comprises a plurality of the power heads, correspondingly, the supporting platform is connected with the plurality of the power heads through a switching mechanism, the switching mechanism can drive the power heads to move so that the corresponding power heads correspond to the first clamping mechanism and the second clamping mechanism, and an output movement direction of the switching mechanism is perpendicular to an output movement direction of the drilling-moving mechanism.

Optionally, the power mechanism comprises a hydraulic impact power head and the multi-speed power head. One end of the output shaft of the multi-speed power head is connected to a multi-pipe flow director, and another end of the output shaft is detachably connected to the drilling tool.

Optionally, the traveling mechanism comprises a vehicle body, wherein a crawler-type traveling member is mounted at a bottom of the vehicle body, four corners of the vehicle body are rotatably connected with connection seats, each of the connection seats is hinged with one end of a supporting arm, and another end of the supporting arm is hinged with a first supporting plate; one end of a driving hydro-cylinder is hinged with the supporting arm, and another end of the driving hydro-cylinder is hinged with the connection seats.

Optionally, the rod-changing robotic arm comprises a robotic arm body, a head end of the robotic arm body is connected with the slewing mechanism mounted on the traveling mechanism, and a tail end of the robotic arm body is provided with a clamping jaw mechanism for clamping and fixing the drilling tool.

The beneficial effects of the present invention are as follows:

1. According to the whole-space drilling-grouting integrated device of the present invention, providing with a rod-changing robotic arm, and a tail end of the platform is provided with a first drilling tool clamping mechanism and a second drilling tool clamping mechanism, the first drilling tool clamping mechanism can rotate around the axis of the output shaft of the power mechanism by using a rotating driving member. When the drilling tool needs to be extended, only the first drilling tool clamping mechanism and the second drilling tool clamping mechanism need to be used to fix the current drilling tool, and then the output shaft of the power mechanism rotates to separate the output shaft from the current drilling tool, then the power mechanism rotates and moves towards the drilling tool direction to connect the power mechanism with the extension section; after the robotic arm releases the extension section, the power mechanism can drive the extension section to connect with the current drilling tool to realize the lengthening of the drilling tool; and the whole lengthening process is carried out automatically without manual assistance, which reduces the labor intensity and the improves the work efficiency.

2. According to the whole-space drilling-grouting integrated device of the present invention, providing with a rod-changing robotic arm, and the end of the platform is provided with a first drilling tool clamping mechanism and a second drilling tool clamping mechanism, the first drilling tool clamping mechanism can rotate around the axis of the output shaft of the power mechanism by using a rotating driving member. When the drilling tool needs to be disassembled segment by segment, only the first drilling tool clamping mechanism and the second drilling tool clamping mechanism need to be respectively positioned on both sides of the matching position of two adjacent segments, the first drilling tool clamping mechanism rotates to loosen two adjacent segments, after the first drilling tool clamping mechanism is loosened, the two adjacent segments can be disassembled by using the power mechanism, and then the drilling tool can be disassembled segment by segment in turn by using the same method; and the whole lengthening process is carried out automatically without manual assistance, which reduces the labor intensity and the improves the work efficiency.

3. According to the whole-space drilling-grouting integrated device of the present invention, providing with a first pitching adjusting hydro-cylinder and a second pitching adjusting hydro-cylinder, which can adjust the pitch angle of the pitching arm and the pitch angle of the platform, and the platform is connected with the slewing mechanism, thereby realizing whole-space multi-angle rotary jet grouting operation.

4. According to the whole-space drilling-grouting integrated device of the present invention, the four corners of the vehicle body are provided with supporting arms, which can drive the vehicle body to lift, so as to support the vehicle body and ensure the stability of the vehicle body in the grouting process; moreover, the supporting arms can rotate, so that the supporting arms can still contact with the ground under complex terrain conditions, and the adaptability of the whole device to terrain is improved.

5. According to the whole-space drilling-grouting integrated device of the present invention, the power mechanism comprises a hydraulic impact power head and a multi-speed power head, can realize drilling-grouting pile formation with multiple functions, and improves the functional diversity and applicability of the whole device.

BRIEF DESCRIPTION OF THE DRAWINGS

The accompanying drawings constituting a part of the present invention are used to provide a further understanding of the present invention. The exemplary examples of the present invention and descriptions thereof are used to explain the present invention, and do not constitute an improper limitation of the present invention.

Wherein: 1, vehicle body; 2, crawler-type traveling member; 3, connection seat; 4, supporting arm; 5, first supporting plate; 6, driving hydro-cylinder; 7, rod-changing robotic arm; 7-1, second supporting plate; 7-2, fixed jaw; 7-3, rotating jaw; 7-4, clamping hydro-cylinder; 8, base; 9, second slewing mechanism; 10, pitching arm; 10-1, fixed arm part; 10-2, telescopic arm part; 10-3, first telescopic driving hydro-cylinder; 11, third slewing mechanism; 12, first pitching adjusting hydro-cylinder; 13, second pitching adjusting hydro-cylinder; 14, platform; 14-1, fixed platform part; 14-2, telescopic platform part; 14-3, second telescopic driving hydro-cylinder; 15, supporting platform; 16, drilling-moving hydro-cylinder; 17, first drilling tool clamping mechanism; 18, second drilling tool clamping mechanism; 19, arc-shaped guide rail; 20, drilling tool; 21, U-frame; 22, guide rail plate; 23, rotating driving hydro-cylinder; 24, clamping driving hydro-cylinder; 25. clamping block; 26, switching plate; 27, switching hydro-cylinder; 28, hydraulic impact power head; 29, multi-speed power head; 30, control cabinet; 31, operating platform; 32, grouting pump; 33, storage bin; 34, air pump; 35, gas storage tank; 36, control valve; 37, water storage tower; 38, water pump; 39, control system; 40, slurry; 41, air curtain; 42, drill bit body; 43, slurry outlet; 44, main air port; 45, pressure sensor; 46, water outlet; 47, slurry discharge inlet; 48, gate;

29-1, input shaft; 29-2, output shaft; 29-3, first input gear; 29-4, first output gear; 29-5, second input gear; 29-6, second output gear; 29-7, first clutch wheel; 29-8, third input gear; 29-9, third output gear; 29-10, second clutch wheel; 29-11, hydraulic motor; 29-12, two-position two-way electromagnetic valve.

DETAILED DESCRIPTION

For the purpose of description, if the words "upper" and "lower" appear in the present invention, they only means that they are consistent with the up and down directions of the drawings themselves, and does not limit the structure, but is only for the purpose of describing the present invention and simplifying the description, and does not indicate or imply that the equipment or components referred to must have a specific orientation, be constructed and operated in a specific orientation, and therefore cannot be construed as a limitation of this application.

Embodiment 1

Figure 1:
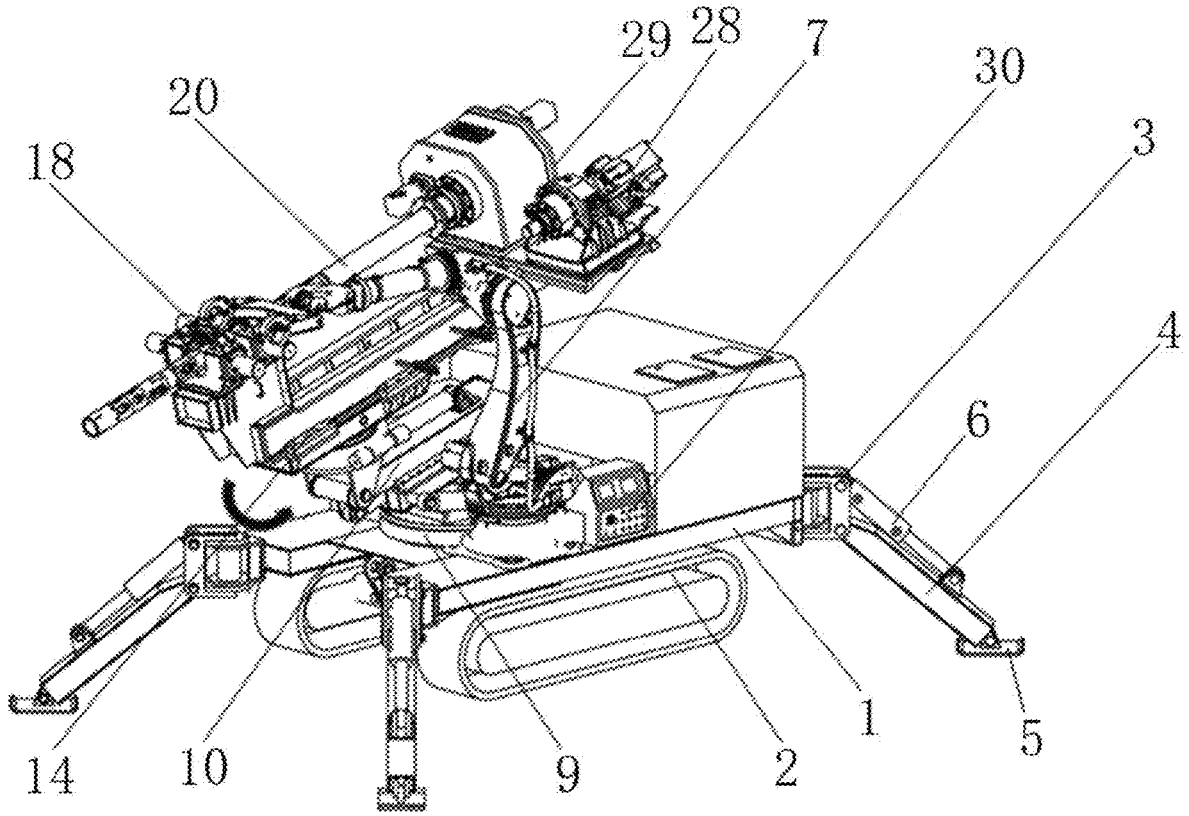
FIG. 1 is a structural diagram of an overall structure of an Embodiment 1 of the present invention.

The present embodiment provides a whole-space drilling-grouting integrated device, as shown in FIG. 1, comprising a traveling mechanism, and a drilling-grouting mechanism and a rod-changing robotic arm mounted on the traveling mechanism.

The traveling mechanism comprises a vehicle body 1, and a crawler-type traveling member 2 is mounted on a bottom surface of the vehicle body 1. The crawler-type traveling member 2 may be a conventional one, and a detailed structure thereof will not be described here.

Each of four corners of the vehicle body 1 is rotatably connected with a connection seat 3, the connection seat 3 is hinged with one end of a supporting arm 4, and another end of the supporting arm 4 is rotatably connected with a supporting plate 5.

An upper surface of the supporting arm 4 is provided with a hinged seat which is hinged with a piston rod of a driving hydro-cylinder 6 through the hinged seat, and a cylinder body of the driving hydro-cylinder 6 is hinged with the connection seat.

An extension of the piston rod of the driving hydro-cylinder 6 drives the supporting arm 4 to rotate. The support plate 5 is in contact with a ground foundation. The rotation of the supporting arm 6 can lift the entire vehicle body 1, thereby supporting the vehicle body 1 and ensuring the stability of the vehicle body 1 during the grouting process. Moreover, the rotation of supporting arm 4 can make the supporting arm 4 still be in contact with the ground under complex terrain conditions, improving the adaptability of the entire device to the terrain.

The rod-changing robotic arm 7 may be an existing separable six-joint robotic arm, and a specific structure thereof is not described in detail herein.

A head end of the separable six-joint robotic arm is connected with a first slewing mechanism, and the first slewing mechanism is mounted on the vehicle body 1. In the present embodiment, the first slewing mechanism can be an existing slewing platform, and a clamping jaw mechanism is arranged at a tail end of the separable six-joint robotic arm, and used for clamping, fixing and releasing the drilling tool.

The clamping jaw mechanism comprises a supporting plate 7-1, wherein the supporting plate 7-1 is fixed with the tail end of the separable six-joint robotic arm; fixed jaws 7-2 are arranged on both sides of the supporting plate 7-1; rotating jaws 7-3 matched with the fixed jaws 7-2 are rotatably connected to the both sides of the supporting plate 7-1; the rotating jaws 7-3 are hinged with piston rods of clamping hydro-cylinders 7-4; cylinder bodies of the clamping hydro-cylinders 7-4 are hinged with the supporting plate 7-1; extension and contraction of piston rods of the clamping hydro-cylinders 7-4 can drive the rotating jaws 7-3 to rotate; the rotation of the rotating jaws 7-3 is matched with the fixation of the fixed jaw 7-2 to realize the switching between the clamping and fixing state and the releasing state of the drilling tool.

One side of the rod-changing robotic arm 7 is provided with the drilling-grouting mechanism mounted on the vehicle body.

Figure 2:
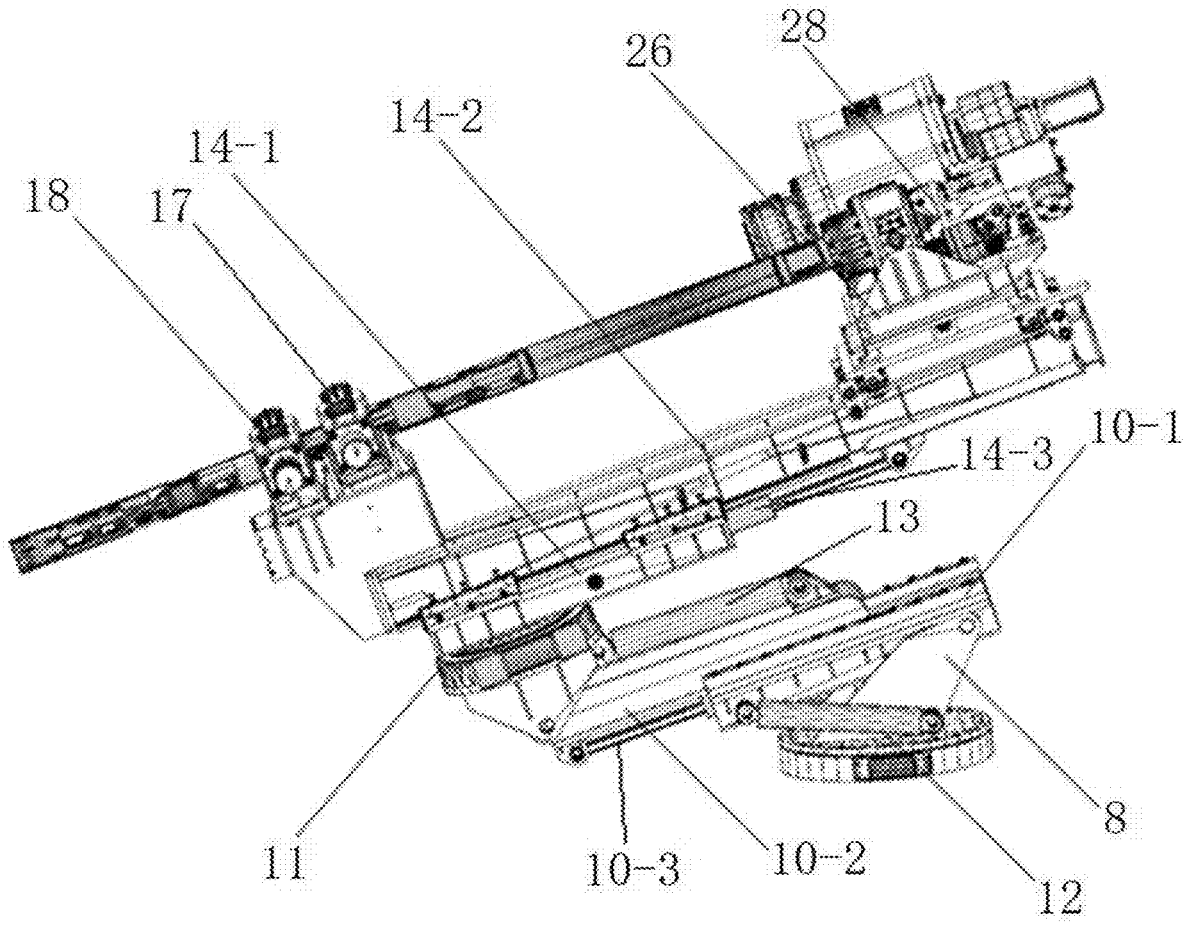
FIG. 2 is a structural diagram of an adjusting mechanism according to the Embodiment 1 of the present invention.

As shown in FIG. 2, the drilling-grouting mechanism comprises an adjusting mechanism, the adjusting mechanism is connected with a platform, the platform is connected with the supporting platform through the drilling-moving mechanism, the supporting platform is fixed with a power mechanism, and an output shaft of the power mechanism is detachably connected with the drilling tool.

The adjusting mechanism comprises a base 8, wherein the base 8 is connected with a second slewing mechanism 9 mounted on the vehicle body; the second slewing mechanism 9 can be an existing slewing platform; the base 8 is hinged with one end of a pitching arm 10; another end of the pitching arm 10 is hinged with a third slewing mechanism 11; the third slewing mechanism 11 can be an existing slewing platform; and, the third slewing mechanism 11 is connected with the platform.

The base 8 is hinged with an end of a cylinder body of the first pitching adjusting hydro-cylinder 12, an end of a piston rod end of the first pitching adjusting hydro-cylinder 12 is hinged with the pitching arm 10, and the extension and contraction of the piston rod of the first pitching adjusting hydro-cylinder 12 can drive the pitching arm to pitch, to adjust an included angle between the pitching arm and the vehicle body.

A second pitching adjusting hydro-cylinder 13 is arranged between the third slewing mechanism 11 and the pitching arm, an end of a cylinder body of the second pitching adjusting hydro-cylinder 13 is hinged with the pitching arm 10 through a hinged seat, a piston rod of the second pitching adjusting hydro-cylinder 13 is hinged with a fixed portion of the third slewing mechanism 11 through a hinged seat, the extension and contraction movement of the piston rod of the second pitching adjusting hydro-cylinder 13 is configured to adjust an included angle between the third slewing mechanism 11 and the pitching arm 10, to achieve a pitching adjustment motion of the platform relative to the pitching arm.

In the present embodiment, the pitching arm 10 is of a telescopic structure and comprises a fixed arm part 10-1 and a telescopic arm part 10-2 telescopically connected with the fixed arm part 10-1. The first pitching hydro-cylinder 12 is disposed between the fixed arm part 10-1 and the base 8, and the second pitching hydro-cylinder 13 is disposed between the telescopic arm part 10-2 and the third slewing mechanism 11.

A first telescopic driving hydro-cylinder 10-3 is arranged between the fixed arm part 10-1 and the telescopic arm part 10-2. An end of a cylinder body of the first telescopic driving hydro-cylinder 10-3 is hinged with the fixed arm part 10-1, and a piston rod thereof is hinged with the telescopic arm part 10-2. The extension and contraction of the piston rod of the first telescopic driving hydro-cylinder 10-3 can drive the telescopic arm part 10-2 to perform a telescopic motion relative to the fixed arm part 10-1.

The platform 14 is also of a telescopic structure and comprises a fixed platform part 14-1 and a telescopic platform part 14-2, wherein the fixed platform part 14-1 and the telescopic platform part 14-2 are slidably connected to realize a telescopic movement; the fixed platform part 14-1 is connected with the third slewing mechanism 11, a second telescopic driving hydro-cylinder 14-3 is arranged between the fixed platform part 14-1 and the telescopic platform part 14-2 and configured to perform the telescopic movement of the fixed platform part 14-1 and the telescopic platform part 14-2, wherein a piston rod of the second telescopic driving hydro-cylinder 14-3 is hinged with the fixed platform part 14-1, and an end of a cylinder body thereof is hinged with the telescopic platform part 14-2. The extension and contraction of the piston rod of the second telescopic driving cylinder 14-3 can drive the telescopic platform part 14-2 to perform telescopic motion relative to the fixed platform part 14-1.

The drilling-moving mechanism is provided on the telescopic platform part 14-2 and connected with the supporting platform 15, and the supporting platform 15 is slidably connected with the telescopic platform part 14-2 through rollers, so that the drilling-moving mechanism can drive the supporting platform to move along a drilling direction of the drilling tool.

In the present embodiment, the drilling-moving mechanism is a drilling-moving cylinder 16, an end of a piston rod of the drilling-moving cylinder 16 is connected to an end of the telescopic platform part 14-2, and a cylinder body of the drilling-moving cylinder 16 is connected to the supporting platform 15.

The power mechanism is mounted on the supporting platform 15, and the power mechanism is detachably connected with the drilling tool to realize rotation and drilling of the drilling tool.

Figure 3:
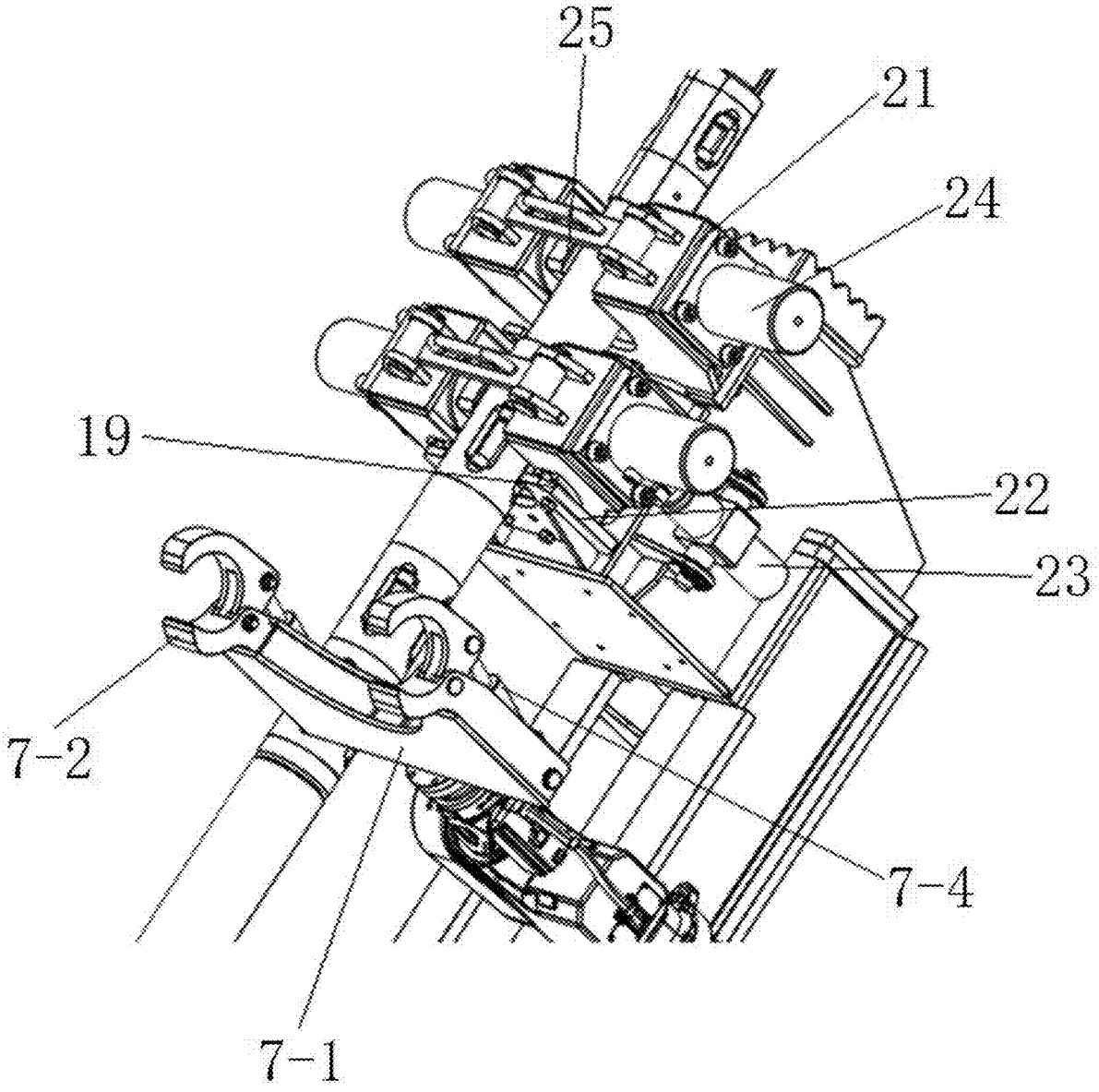
FIG. 3 is a structural diagram of a first drilling tool clamping mechanism and a second drilling tool clamping mechanism according to the Embodiment 1 of the present invention.

As shown in FIG. 3, a first drill tool clamping mechanism 17 and a second drill tool clamping mechanism 18 are disposed at the end of the telescopic platform part 14-2, wherein the second drill tool clamping mechanism 18 is disposed further away from the power mechanism than the first drill tool clamping mechanism.

The second drilling tool clamping mechanism 18 is fixedly connected to the telescopic platform part 14-2, and the first drilling tool clamping mechanism 17 is slidably connected to an arc-shaped guide rail 19 provided on the telescopic platform part 14-2, so that the first drilling tool clamping mechanism 17 can rotate around the axis of the drilling tool 20.

The first drilling tool clamping mechanism 17 and the second drilling tool clamping mechanism 18 each comprise a U-shaped frame 21, wherein the U-shaped frame 21 of the second drilling tool clamping mechanism 18 is fixedly connected with a fixing seat, and the fixing seat is fixed at the end of the telescopic platform part 14-2.

Interiors of the U-shaped frames 21 of the first drilling tool clamping mechanism 17 and the second drilling tool clamping mechanism 18 define a space for the drill 20 to pass through.

Guide rail plates 22 are arranged on both sides of the U-shaped frame 21 of the first drilling tool clamping mechanism 17, the guide rail plates 22 are fixed on the fixing seats, arc-shaped guide rails 19 are arranged on the guide rail plates 22, and the arc-shaped guide rails 19 are embedded into arc-shaped sliding grooves arranged on an end surfaces of the U-shaped frame 21, so that the U-shaped frame 21 of the first drilling tool clamping mechanism 17 is connected with the guide rail plates in a sliding manner.

The U-shaped frame 21 of the first drill tool clamping mechanism 17 is further connected to a rotating driving member, which can drive the U-shaped frame 21 to move along the arc-shaped guide rail 19, thereby causing the U-shaped frame 21 to rotate around the axis of the drill tool 20.

The rotating driving member is a rotating driving hydro-cylinder 23, a cylinder body of the rotating driving hydro-cylinder 23 is hinged with a hinged seat arranged on a side surface of the fixing seat, and a piston rod thereof is hinged with a side portion of the U-shaped frame 21 of the first drilling tool clamping mechanism 17, and the extension and contraction of the piston rod of the rotating driving hydro-cylinder 23 can drive the U-shaped frame 21 of the first drilling tool clamping mechanism 17 to rotate.

the U-shaped frames 21 of the first drilling tool clamping mechanism 17 and the second drilling tool clamping mechanism 18 are provided with two clamping driving members which are coaxially and oppositely arranged, the clamping driving members are a clamping driving hydro-cylinder 24, cylinder bodies of the clamping driving hydro-cylinders 24 are fixedly connected with the U-shaped frames 21, piston rods of the clamping driving hydro-cylinders 24 extend into the inner space of the U-shaped frames 21 and are connected with clamping blocks 25, and two clamping blocks 25 are used for clamping and fixing the drilling tool 20. Further, V-shaped grooves are provided on opposite sides of the two clamping blocks 25, i.e., the sides for contacting the drilling tool 20, to meet the clamping and fixing requirements for the drilling tool 20.

In order to meet the requirements of different drilling-grouting processes, the power mechanism comprises a plurality of power heads. In the present embodiment, the power mechanism comprises two power heads which are respectively used for connecting different drilling tools 20. To make the drilling tools connected with the two power heads correspond to the first drilling tool clamping mechanism 17 and the second drilling tool clamping mechanism 18, the two power heads are connected with a switching mechanism which can drive the two power heads to move along the direction which is perpendicular to the output movement of the drilling-moving mechanism, to realize the correspondence between the drilling tools connected with different power heads and the first drilling tool clamping mechanism or the second drilling tool clamping mechanism through the switching mechanism.

Figure 4:
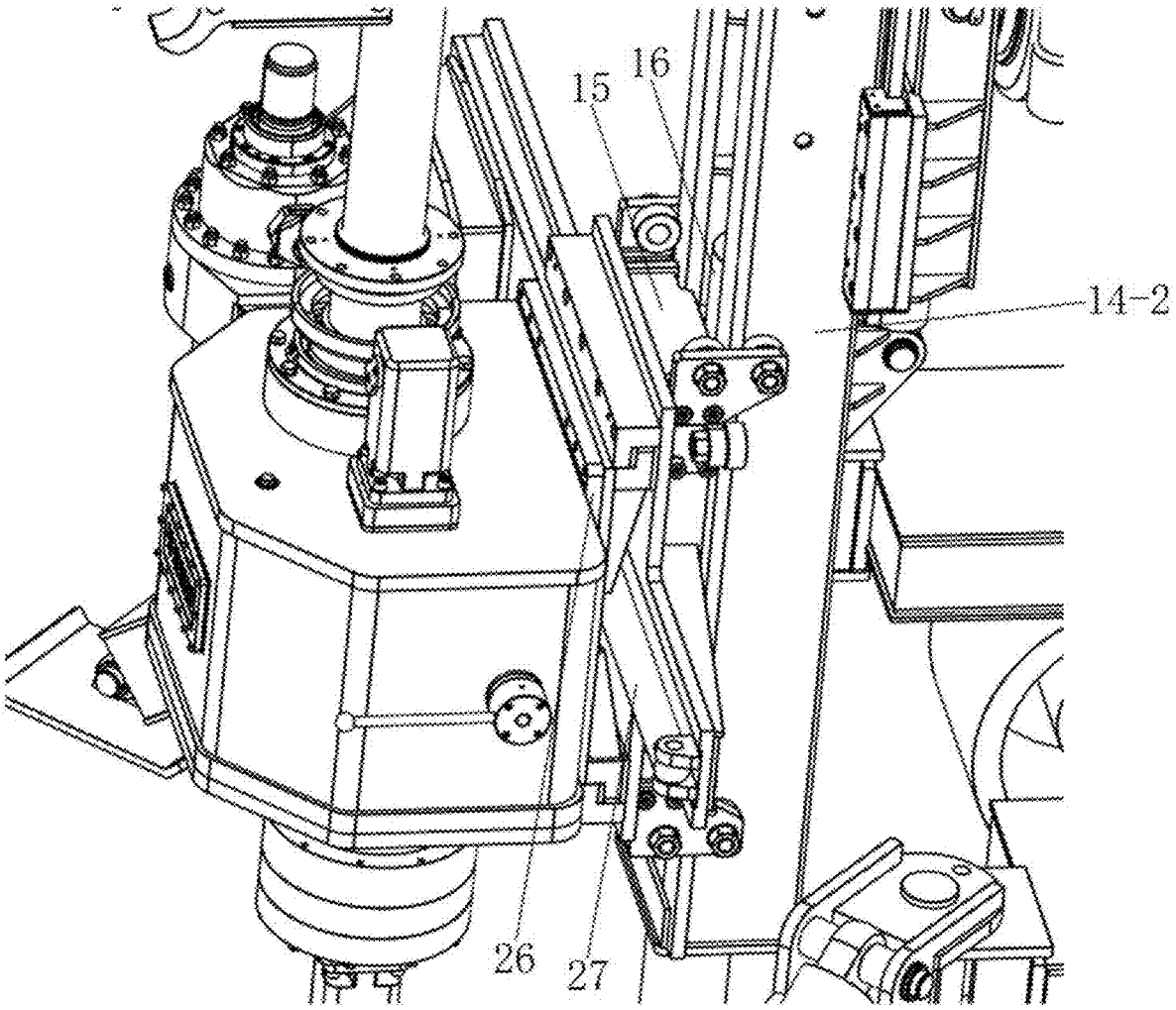
FIG. 4 is a structural diagram of a switching mechanism according to the Embodiment 1 of the present invention.

As shown in FIG. 4, the switching mechanism comprises a switching plate 26, the two power heads are mounted on the switching plate 26, the switching plate 26 is connected with the supporting plate 15 in a sliding manner, a switching driving member is arranged between the switching plate 26 and the supporting plate 15, the switching driving member is a switching hydro-cylinder 27, a cylinder body of the switching hydro-cylinder 27 is hinged with the supporting plate 15, and a piston rod thereof is hinged with the switching plate 26; and, an axis of the switching cylinder 27 and the axis of the drill 20 are perpendicular to each other.

In the present embodiment, the two power heads are a hydraulic impact power head 28 and a multi-speed power head 29, respectively; wherein, the hydraulic impact power head 28 can be an existing equipment, such as a single-speed impact power head, which performs drilling and rock impact breaking after connecting with the drilling tool, to realize rock drilling and rock breaking on rock masses under complex formation environment without sticking.

The multi-speed power head 29 can provide rotation at multiple speeds to realize the high-pressure rotary jet grouting or static grouting.

By arranging the switching hydro-cylinder, switching between the hydraulic impact power head 28 and the multi-speed power head 29 can be realized, manual switching or setting of two devices is not required, and construction efficiency is improved.

Compared with the conventional single-speed power head, the multi-speed power head 29 of the present embodiment has the same output shaft, but a transmission mechanism being added to the single-speed power head, wherein the transmission mechanism may be an existing multi-speed transmission and will not be described in detail herein, such as the transmission disclosed by Chinese Patent Application Pub. No. CN106351225A.

Figure 5:
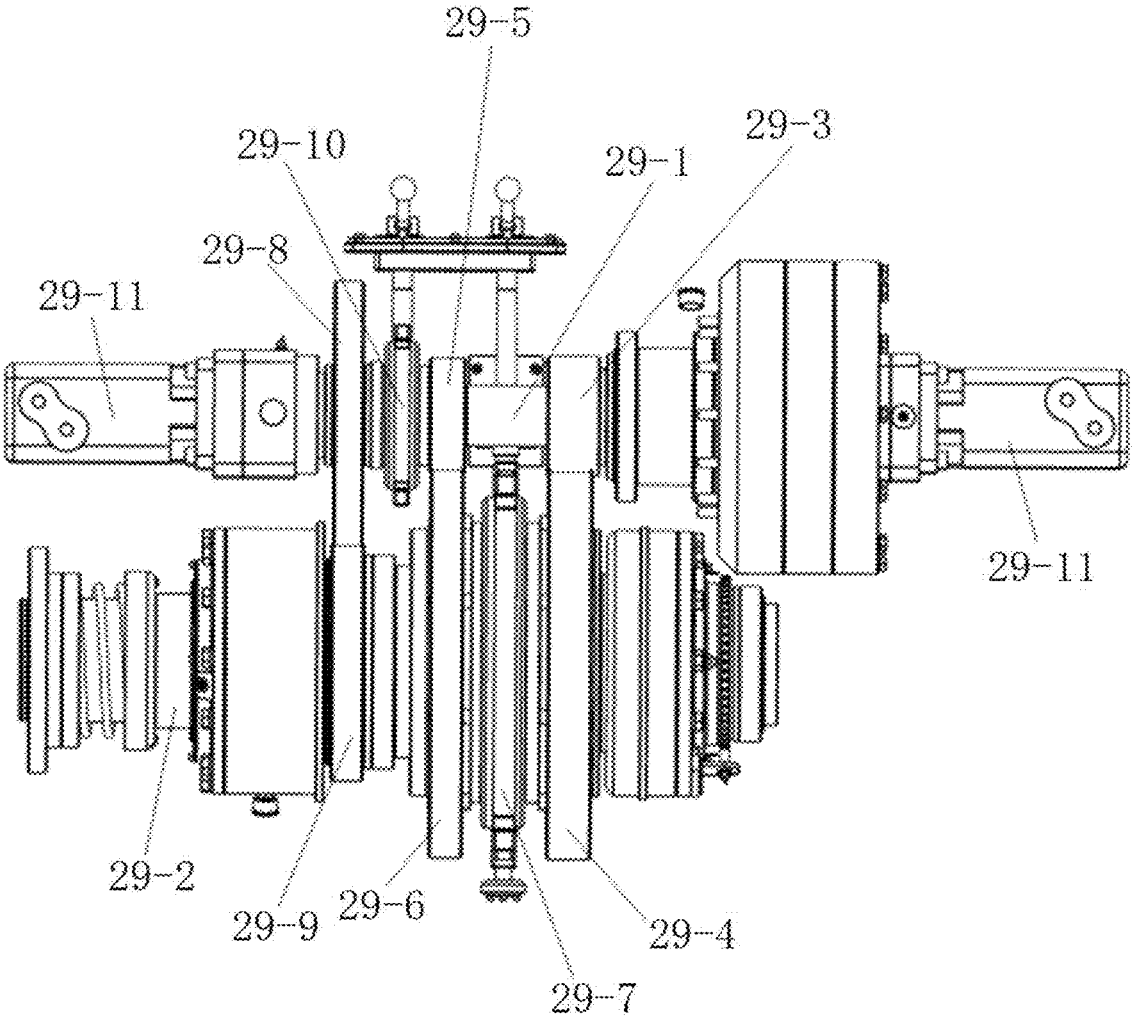
FIG. 5 is a structural diagram of a multi-speed power head according to the Embodiment 1 of the present invention.

In another embodiment, as shown in FIG. 5, the multi-speed power head 29 comprises a shell providing with an input shaft 29-1 and an output shaft 29-2, wherein the input shaft 29-1 is connected with the power assembly and can rotate under the drive of the power assembly, one end of the output shaft 29-2 is used for connecting the multi-pipe flow director, and another end of the output shaft 29-2 is used for detachably connecting the drilling tool.

One end of the input shaft 29-1 is rotatably connected with a first input gear 29-3, and the first input gear 29-3 is connected with a planetary reduction mechanism; the planetary reduction mechanism is connected with the power assembly, and the power assembly can drive the first input gear 29-3 to rotate through the planetary reduction mechanism. A first output gear 29-4 is meshed with the first input gear 29-3, the first output gear 29-4 is rotatably connected to the output shaft 29-2, and the first input gear 29-3 can drive the first output gear 29-4 to rotate, wherein numbers of teeth of the first input gear 29-3 and the first output gear 29-4 are set to output a deceleration motion. A second input gear 29-5 is further fixedly connected to the input shaft 29-1, a second output gear 29-6 is meshed with the second input gear 29-5, the second output gear 29-6 is rotatably connected with the output shaft 29-2, and the second input gear 29-5 can drive the second output gear 29-6 to rotate, to output a deceleration motion.

A first clutch wheel 29-7 is connected to the output shaft 29-2 through a key, and can synchronously rotate with the output shaft 29-2 and simultaneously moves along an axis direction of the output shaft 29-2; two end surfaces of the first clutch wheel 29-7 are provided with projections, and end surfaces of the first output gear 29-4 and the second output gear 29-6 are provided with spline grooves matched with the projections; and, the first clutch wheel 29-7 can be engaged with the first output gear 29-4 or the second output gear 29-6 for synchronous rotation through the projections and the spline grooves.

A third input gear 29-8 is further rotatably connected to the input shaft 29-1, a third output gear 29-9 meshes with the third input gear 29-8, and is fixed on the output shaft 29-2, and numbers of teeth of the third input gear 29-8 and the third output gear 29-9 are set to output a speed-increasing motion.

A second clutch wheel 29-10 is connected to the input shaft 29-1 through a key, the second clutch wheel 29-10 can rotate synchronously with the input shaft 29-1 and simultaneously can move along the axial direction of the input shaft 29-1, an end face of the second clutch wheel 29-10 is provided with a projection, the third input gear 29-8 is provided with a spline groove matched with the projection, and the second clutch wheel 29-10 can be matched with the third input gear 29-8 through the projection and the spline groove.

The first clutch wheel 29-7 and the second clutch wheel 29-10 are both connected with shift fork parts which have the same structure and can adopt the prior art, the shift fork parts comprise a rotating shaft which is rotatably connected with the shell, an outer end part of the rotating shaft is connected with a handle, a shaft surface of the rotating shaft is fixed with a middle portion of an outer arc surface of a semicircular ring, two end of the semicircular ring are hinged with push blocks, the push blocks are embedded in annular grooves arranged on wheel surfaces of the clutch wheels, the handle drives the rotating shaft to rotate, can drive the clutch wheels to perform linear motion through the semicircular ring and the push blocks.

The power assembly comprises two hydraulic motors 29-11, both of which are connected to the input shaft 29-1, wherein one of the hydraulic motors 29-11 is connected to the planetary reduction mechanism, and the two hydraulic motors 29-11 are connected to an oil supply system through a two-position two-way electromagnetic valve 29-12 to realize the switching between a parallel connection and a series connection of the two hydraulic motors.

Figure 6:
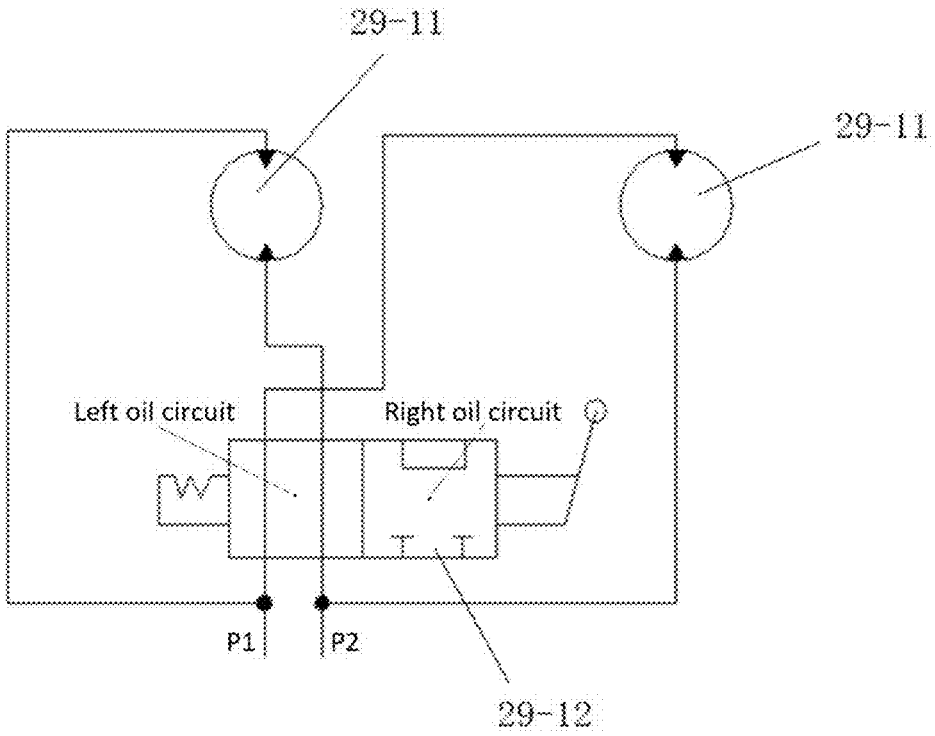
FIG. 6 is a schematic diagram of an operation mode of a hydraulic motor according to the Embodiment 1 of the present invention.

As shown in FIG. 6, a point P1 in the oil circuit is connected to an oil pump and a point P2 is connected to an oil tank. When a left oil circuit of the two-position two-way electromagnetic valve works, the two hydraulic motors work in parallel, and when a right oil circuit of the two-position two-way electromagnetic valve works, the two hydraulic motors work in series.

According to the multi-speed power head of the present embodiment, the first clutch wheel is matched with the first output gear or the second output gear, the second clutch wheel may be matched with the third output gear, and the two hydraulic motors may be connected in parallel or in series, so that six speeds may be output. Under any conditions of the two hydraulic motors are connected in series or in parallel, wherein when the multi-speed power head is in a high speed (e.g., a highest speed output) or a low speed (e.g., a speed output between the high speed and an ultra-low speed), the drilling and coring of reinforced concrete lining can be carried out; and, when the multi-speed power head is in the ultra-low speed (e.g. a lowest speed output), the high-pressure rotary grouting can be carried out.

During construction, whether the two hydraulic motors are connected in series or in parallel can be determined according to the actual working conditions.

One end of the output shaft of the multi-speed power head 29 is detachably connected to the drilling tool 20 through a screw thread structure, and another end is connected to the multi-pipe flow director, which can be an existing device, and the specific structure thereof is not described in detail herein.

The drilling tool connected to the multi-speed power head 29 may be an existing single-pipe drilling tool, double-pipe drilling tool or three-pipe drilling tool, etc.

Figure 7:
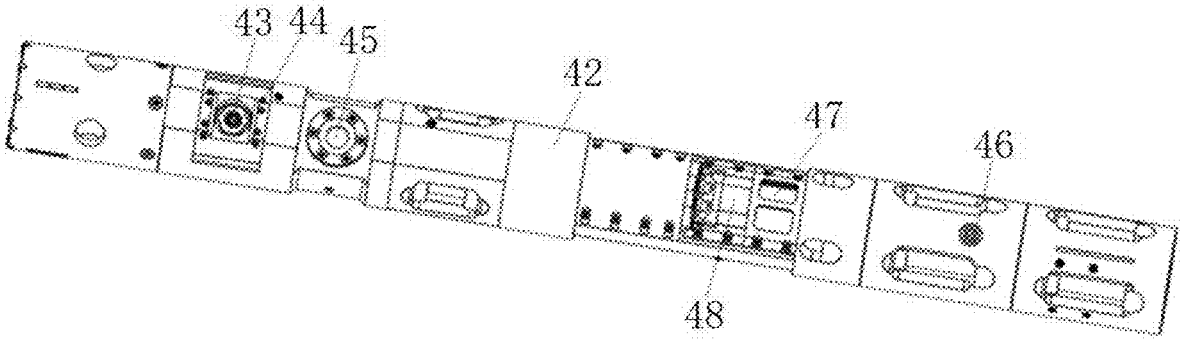
FIG. 7 is a structural diagram of a drill bit according to the Embodiment 1 of the present invention.

In the present embodiment, the drilling tool to which the multi-speed power head 29 is connected is a drilling tool for a multi-tube rotary jet grouting method, as shown in FIG. 7, comprising a drill rod and a drill bit, wherein the drill rod is composed of a plurality of rod segments connected by threads, the drill bit comprises a drill bit body 42, a slurry outlet 43 is arranged at a front of the drill bit body 42 and is communicated with a slurry channel inside the drill bit body 42; a plurality of main air ports 44 are arranged at a periphery of the slurry outlet 43 and are communicated with a main air channel inside the drill body 42, a pressure sensor 45 mounted on the drill body 42 is arranged behind the slurry outlet 43, a slurry discharge channel extending to a rear end face of the drill bit body is arranged at a rear part of the drill bit body 42, and the slurry discharge channel is connected with a slurry discharge inlet 47 arranged on the drill bit body 42; a switch hydro-cylinder is arranged on the drill bit body 42, a cylinder body of the switch hydro-cylinder is connected to the drill bit body 42, a piston rod of the switch hydro-cylinder is connected to a gate 48, and the piston rod of the switch hydro-cylinder can drive the gate 48 to move along an axial direction of the drill bit body to adjust an opening degree of the slurry discharge inlet; furthermore, the auxiliary gas channel is also provided inside the drill bit body, wherein one end of the auxiliary gas channel is communicated with a rear of the slurry discharge channel, and another end extends to a rear end face of the drill bit body; moreover, a cable channel is also provided in the drill bit body, wherein a cable connected to the pressure sensor is placed in the cable channel, and a water outlet is also provided on a front end face of the slurry discharge channel, to be communicated with a water channel provided in the drill bit body. In addition, a water outlet 46 is also provided at the rear of the drill bit body, and the water outlet 46 is communicated with the water channel provided in the drill bit body for spraying water to assist cutting.

The drill rod is internally provided with channels communicated with corresponding channels in the drill bit body, and comprises a slurry channel, a gas channel, a slurry discharge channel and the like.

A magnetostrictive displacement sensor for detecting an amount of an extension length of the piston rod of the switch hydro-cylinder is arranged between the gate and the drill bit body, so as to accurately control the opening degree of the slurry discharge inlet.

In the present embodiment, the pressure sensor may collect the pressure of slurry between the drill bit and the drill hole, and the switch hydro-cylinder may drive the gate 48 to move to adjust the opening degree of the slurry discharge inlet, so that the pressure of slurry between the drill hole and the drill bit may be adjust, and the size of the consolidated body formed by grouting can be controlled, so that the applicability of the whole drill bit is improved.

The drilling tool 20 of the present embodiment may inject gas to the rear of the slurry discharge channel through the auxiliary gas channel to form a gas lift phenomenon, reduce the density of slurry at the rear of the slurry discharge channel, thereby promoting the discharge of slurry, mud and gas in the slurry channel, and facilitating the formation of cylindrical consolidated bodies by grouting.

In the present embodiment, each of the hydro-cylinders is connected to a hydraulic station mounted on the vehicle body 1, and oil is supplied to the hydro-cylinders by the hydraulic station. The hydraulic station is connected to a control system, and an operation of the hydraulic station is controlled by the control system. In addition, the traveling mechanism and the power mechanism are further connected to the control system to control their operation.

The control system is placed in a control cabinet 30, the control cabinet is rotatably connected to one end of a connecting rod through a rotating shaft, another end of the connecting rod is rotatably connected to the vehicle body, so that the control cabinet may be folded above the vehicle body and unfolded to the outer side of the vehicle body through the connecting rod; and, an operation platform 31 is arranged on an outer side surface of the control cabinet and is connected to the control system, for sending instructions to the control system by constructors.

The working method of the all-space drilling-grouting integration device of the present embodiment is as follows.

Travelling the traveling mechanism to a set position by the crawler-type traveling member 2, extending the piston rod of the driving hydro-cylinder 6 out to drive the supporting arm 4 to rotate, and moving the supporting plate 5 to contact with the ground to support the vehicle body 1, thereby ensuring the stability of the whole device.

Grabbing the drill rod of the target drilling tool by the rod-changing robotic arm 7 through the jaw mechanism, then driving the drill rod to move until the drill rod is aligned with the output shaft of the corresponding power end, then driving the output shaft by the power end to rotate and driving simultaneously the power end by the drilling moving mechanism to move, to connect the output shaft of the power end to the corresponding drill rod; splicing a plurality of rod sections of the drill rod in sequence, and finally splicing the drill bit by using the method above.

Adjusting the angle of the assembled and mounted drilling tool by the adjusting mechanism; then, carrying out the drilling operation or grouting operation.

When the hydraulic impact power head is applied to the power head, a hole drilling is performed in rock mass by using the drilling tool.

When the multi-speed power head is applied to the power head, a grouting is performed in the rock mass by using the drilling tool to form the consolidated body.

During the drilling, when the drilling tool needs to be lengthened, the drilling tool 20 is fixed by the first drilling tool clamping mechanism 17 and the second drilling tool clamping mechanism 18, the output shaft of the power end rotates, so that the output shaft of the power end is separated from the drill rod, then the drilling-moving mechanism drives the power end to retreat, leaving a space for lengthening the drill rod, the rod changing robotic arm 7 places the drill rod for lengthening into the reserved space and aligns with the output shaft of the power end, then the output shaft of the power end rotates, and at the same time, the drilling-moving mechanism drives the power end to move forward to fix the lengthened drill rod and the power end, the rod-changing robotic arm 7 releases the lengthened drill rod, the power end continues to drive the lengthened drill rod to rotate and move forward, and the lengthened drill rod is connected with the existing drill rod to complete the lengthening of the drilling tool.

When the drilling tool needs to be disassembled section by section, the drilling-moving mechanism operates to drive the drilling tool to move, so that the threaded connection position of the drilling tool to be separated is placed between the first drilling tool clamping mechanism 17 and the second drilling tool clamping mechanism 18, the clamping driving hydro-cylinders 24 of the first drilling tool clamping mechanism 17 and the second drilling tool clamping mechanism 18 operate to clamp the drilling tool 20 by using the clamping block, and then the U-shaped frame 21 of the first drilling tool clamping mechanism 17 rotates under the drive of the rotating driving hydro-cylinder 23, so that the drilling tool parts on both sides of the threaded connection position are preliminarily loosened, then the clamping driving hydro-cylinder 24 of the first drilling tool clamping mechanism 17 loosens the drilling tool, then the output shaft of the power end rotates and the drilling-moving mechanism drives the power end to retreat synchronously, so as to complete the separation of the parts on both sides of the threaded connection position of the drilling tool to be separated, and the clamping driving hydro-cylinder 24 of the second drilling tool clamping mechanism 18 manually removes the drilling tool part clamped by the second drilling tool clamping mechanism 18 after loosening. Automatic disassembly of multiple parts of the drilling tool is completed section by section in turn by using the method above.

In the present embodiment, the whole process of lengthening and disassembling the drilling tool is automatically performed without manual assistance, so that the labor intensity is reduced and the working efficiency is improved.

Figure 8:
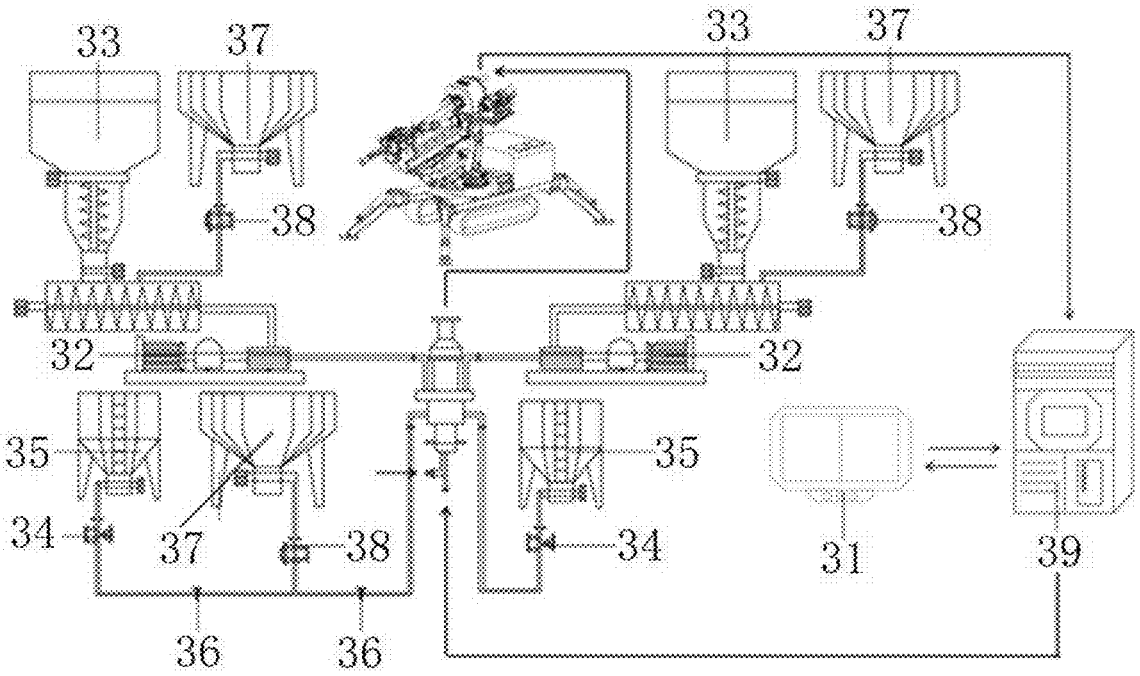
FIG. 8 is a schematic diagram of the Embodiment 1 of the present invention connecting with a deflector, a bin, a water storage tower and a gas holder.

When the drilling tool is the drilling tool for the multi-pipe rotary jet grouting method of the present embodiment, the progressive rotary jet grouting method or the backward rotary jet grouting method can be used. After the drilling tool is mounted, as shown in FIG. 8, the multi-pipe fluid director is connected to the grouting pump 32 through the pipeline, the grouting pump 32 is connected to the storage bin 33 through the pipeline, and the storage bin 33 is used for containing the slurry to be grouted. Since there is a double-liquid grouting in the backward rotary jet grouting method, so the multi-pipe fluid director is connected with two the grouting pumps 32 and two the storage bins 33.

The grouting pump 32 is connected to the storage bin 33 through a screw conveyor, the screw conveyor is also connected to a water storage tower 37 through a pipeline, and a water pump 38 is provided on the pipeline between the screw conveyor and the water storage tower 37.

Since the drilling tool 20 is provided with main air ports and an auxiliary air channel, the multi-pipe fluid director is connected with two air pumps 34 through pipelines, each of the two air pumps 34 is connected to an air storage tank 35, and a pipeline between the air pump 34 and the multi-pipe fluid director is provided with a control valve 36. One pipeline between one of the two air pumps 34 and the multi-pipe flow director is also connected to the water storage tower 37 through the water pump 38, and the control valve 36 is provided between the water pump and the multi-pipe flow director; a control valve is also provided between the water pump and the air pump 34 to switch between water supply and gas supply.

The multi-pipe flow director is connected to the control system 39, and its operation is controlled by the control system 39.

Wherein, the storage bin is connected to the grouting pump through the screw conveyor, and the screw conveyor is also connected with the water storage tower through the water pump.

Figure 9:
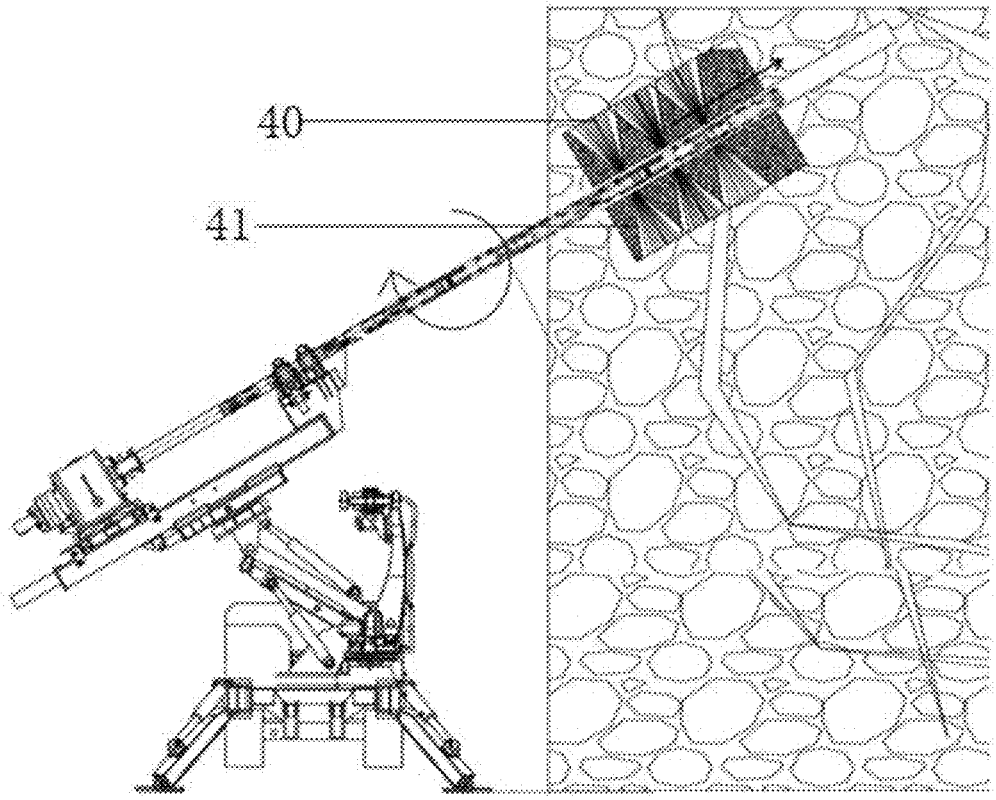
FIG. 9 is a schematic diagram of a progressive rotary jet grouting method according to the Embodiment 1 of the present invention.

When the progressive rotary jet grouting method is adopted, as shown in FIG. 9, the drilling tool moves from the outside to the bottom of the borehole, the power end drives the drilling tool to move along the borehole, while the drilling tool rotates around its own axis, the slurry outlet sprays slurry 40 to realize rotary jet grouting, the sprayed slurry cuts the rock formation, and at the same time, the main air ports spray gas to form an air curtain 41, which cuts the formation together with the sprayed slurry. During the rotary jet grouting process, excess slurry, mud and gas enter the slurry discharge channel through the slurry discharge inlet, and then are discharged. In the process of drilling tool travel, slurry is used to cut rock layer, and finally a cylindrical consolidated body with slurry-soil reinforcement body at the lower part and loose slurry-soil-gas expansion body at the upper part is formed.

Figure 10:
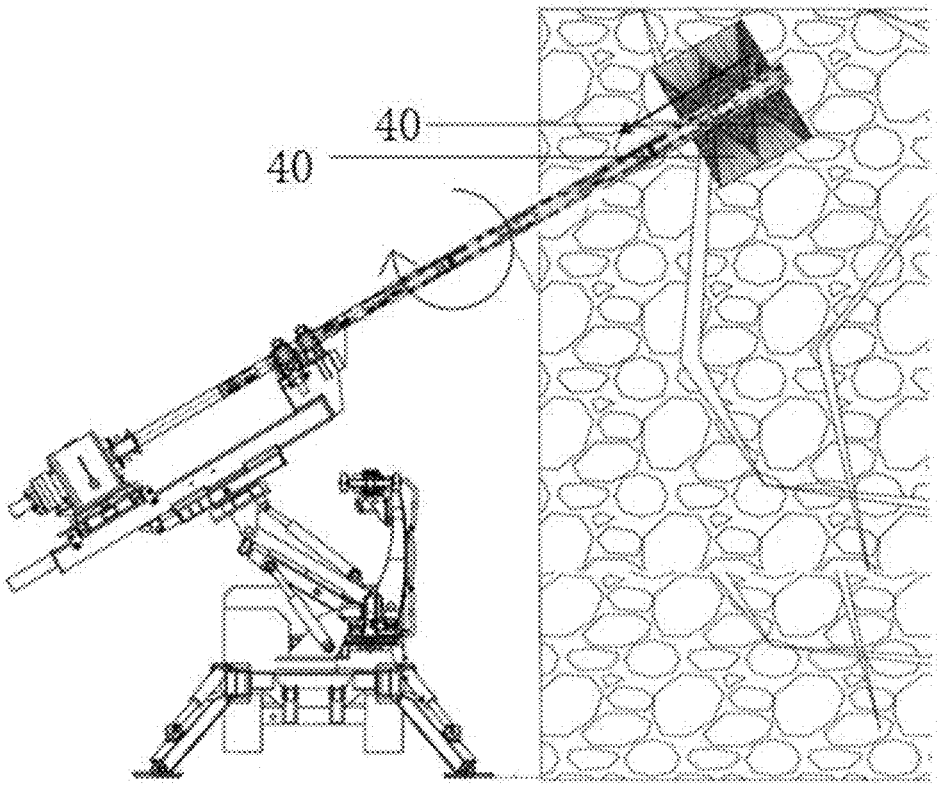
FIG. 10 is a schematic diagram of a backward rotary jet grouting method according to the Embodiment 1 of the present invention.

When the backward rotary jet grouting method is adopted, as shown in FIG. 10, the drilling tool moves from the bottom of the borehole to the outside while rotating around its own axis. No gas is injected from the main air ports, and two kinds of preset slurries 40 mixed in advance are injected through the slurry outlet and cut the rock layer. The excess slurry, mud and gas enter the slurry discharge channel and are discharged. The drilling tool moves along the borehole and cuts the rock layer by using the slurry. Since no gas is injected from the main air ports in the backward rotary jet method, the gas in the soil is small when the slurry cuts the layer, only the gas inside the original soil is contained, and the gas cavity cannot be formed. Finally, a cylindrical consolidated body is formed.

In the grouting process of the two grouting methods above, the pressure of slurry outside the drill bit is detected in real-time by the pressure sensor, and compared with a preset pressure threshold value, and the gate is driven to move by the turning on and off the hydro-cylinder to adjust the opening degree of the slurry discharge inlet, so that the slurry pressure outside the drill bit is further adjusted to keep the slurry pressure within the pressure threshold value range, thereby realizing the control of the size of the consolidated body.

Aiming at frequent water and mud inrush disasters in unfavorable geology such as faults, karsts, crushed silts and the like, the rotary jet grouting method of the present embodiment has high working efficiency, effectively avoids the formation of cavities in the soil body in the grouting process, and has high pile-forming quality.

It can be understood that, by replacing different drilling tools to the multi-speed power head and different output speeds, the static pressure grouting and ordinary high pressure grouting can be realized.

The foregoing descriptions are merely preferred embodiments of the present invention but are not intended to limit the present invention. A person skilled in art may make various alterations and variations to the present invention. Any modification, equivalent replacement, or improvement made within the spirit and principle of the present invention shall fall within the protection scope of the present invention.

The invention claimed is:

1. A whole-space drilling-grouting integrated device, comprising:

a traveling mechanism, wherein a drilling-grouting mechanism is provided on the traveling mechanism, and a rod-changing robotic arm is provided on one side of the drilling-grouting mechanism; the drilling-grouting mechanism comprises an adjusting mechanism, a platform is connected to the adjusting mechanism, and a supporting platform is connected to the platform through a drilling-moving mechanism; a power mechanism is fixed on the supporting platform, an output shaft of the power mechanism is detachably connected with a drilling tool; and a first drilling tool clamping mechanism and a second drilling tool clamping mechanism are arranged at a tail end of the platform, wherein, the second drilling tool clamping mechanism is fixedly connected to an edge of the tail end of the platform, the first drilling tool clamping mechanism is arranged adjacent to the second drilling tool clamping mechanism; the first drilling tool clamping mechanism is connected to an arc-shaped guide rail arranged on the platform in a sliding way and is further connected to a rotating driving member on the platform so as to realize rotation around an axis of an output shaft of the power mechanism;

a multi-speed power head, wherein the multi-speed power head comprises a shell, the shell is provided with an input shaft and an output shaft; wherein, one end of the input shaft is rotatably connected to a first input gear, the first input gear is connected with a planetary reduction mechanism, the planetary reduction mechanism is connected to a power assembly, the power assembly drives the first input gear to rotate through the planetary reduction mechanism; the first input gear is meshed with a first output gear, the first output gear is rotatably connected on the output shaft, and the first input gear drives the first output gear to rotate; the input shaft is also fixedly connected to a second input gear, the second input gear is meshed with a second output gear, the second output gear is rotatably connected to the output shaft, and the second input gear drives the second output gear to rotate; a first clutch wheel is connected to the output shaft through a key, and moves along an axis direction of the output shaft while rotating synchronously with the output shaft; the input shaft is also rotatably connected to a third input gear, the third input gear is meshed with a third output gear, and the third output gear is fixed to the output shaft; a second clutch wheel is connected to the input shaft through a key, and the second clutch wheel rotates synchronously with the input shaft and moves along an axial direction of the input shaft; wherein the multi-speed power head may provide six different speeds through a cooperation between the first clutch wheel with the first output gear or the second output gear, a cooperation between the second clutch wheel with the third output gear, and a parallel or series connection of two hydraulic motors; in a state where the two hydraulic motors are connected in series or parallel, when the multi-speed power head is in a high or low speed, carrying out a drilling and coring of a reinforced concrete lining; when the power head is in a ultra-low speed, carrying out a high-pressure rotary jet grouting; and the drilling tool is further detachably connected to the multi-speed power head through the output shaft of the power mechanism wherein the drilling tool comprises a drill rod, a drill bit is detachably connected to an end part of the drill rod, a grouting channel and a main gas channel are arranged both in the drill rod and the drill bit, a slurry outlet arranged on the drill bit is communicated with the grouting channel, a plurality of main gas ports are arranged on a periphery of the slurry outlet, the plurality of the main gas ports are communicated with the main gas channel in the drill bit; a slurry discharge channel is arranged in both the drill rod and the drill bit, a slurry inlet of the slurry discharge channel extends to a rear part of the drill bit, correspondingly, a slurry discharge inlet is provided on the drill bit for communicating with the slurry discharge channel; further, an auxiliary gas channel is arranged in both the drill rod and the drill bit, an air outlet end of the auxiliary gas channel extends to a rear part of the slurry discharge channel in the drill bit and is communicated with the slurry discharge channel; wherein when a progressive rotary jet grouting method is used, a slurry is jetted out from the slurry outlet to perform the rotary jet grouting; simultaneously, an air curtain is formed by a gas jetted out from the plurality of the main gas ports, cutting a formation together with the jetted slurry, to finally form a cylindrical consolidated body with a grout-soil reinforcement body at a lower part and a loose grout-soil-gas expansion body at an upper part.

2. The device according to claim 1, wherein the first drilling tool clamping mechanism and the second drilling tool clamping mechanism both comprise a frame, wherein the frame is of a U-shaped structure to form a space for the drilling tool to pass through, a pair of clamping driving members is arranged oppositely and is connected to the frame, each of the clamping driving members is connected with a clamping block, the frame of the first drilling tool clamping mechanism is connected with an arc-shaped guide rail in a sliding way, and the frame of the second drilling tool clamping mechanism is fixedly connected with the platform.

3. The device according to claim 1, wherein the rotating driving member is of a rotating driving hydro-cylinder, a cylinder body of the rotating driving hydro-cylinder is hinged with the platform, and a piston rod of the rotating driving hydro-cylinder is hinged with one side of the first drilling tool clamping mechanism, so as to drive the first drilling tool clamping mechanism to rotate through an expansion and contraction of the piston rod.

4. The device according to claim 1, wherein the adjusting mechanism comprises a base, wherein the base is hinged with a bottom end of a pitching arm, a first end of a first pitching adjusting hydro-cylinder is hinged with the base, and a second end of the first pitching adjusting hydro-cylinder is hinged with the pitching arm, a top end of the pitching arm is rotatably connected with a slewing mechanism, the slewing mechanism is connected with the platform, a first end of a second pitching adjusting hydro-cylinder is hinged with the slewing mechanism, and a second end of the second pitching adjusting hydro-cylinder is hinged with the pitching arm.

5. The device according to claim 4, wherein the pitching arm comprises a fixed arm part, a telescopic arm part is slidably connected to the fixed arm part, a first telescopic driving hydro-cylinder is arranged between the fixed arm part and the telescopic arm part, the fixed arm part is hinged with the base, the first pitching adjusting hydro-cylinder is arranged between the fixed arm part and the base, the telescopic arm part is hinged with the slewing mechanism, and the second pitching adjusting hydro-cylinder is arranged between the slewing mechanism and the telescopic arm part.

6. The device according to claim 1, wherein the platform comprises a fixed platform part and a telescopic platform part, wherein the fixed platform part is connected with a slewing mechanism; the telescopic platform part is connected with the fixed platform part in a sliding manner; a second telescopic driving hydro-cylinder is arranged between the telescopic platform part and the fixed platform part; and the telescopic platform part is connected with the supporting platform through a moving mechanism.

7. The device according to claim 1, wherein the power mechanism comprises a plurality of the power heads; correspondingly, the supporting platform is connected with the plurality of the power heads through a switching mechanism, the switching mechanism can drive the power heads to move so that the corresponding power heads correspond to the first clamping mechanism and the second clamping mechanism, and an output movement direction of the switching mechanism is perpendicular to an output movement direction of the drilling-moving mechanism.

8. The device according to claim 7, wherein the power mechanism comprises a hydraulic impact power head and the multi-speed power head, wherein one end of the output shaft of the multi-speed power head is connected to a multi-pipe flow director, and another end of the output shaft is detachably connected to the drilling tool.

9. The device according to claim 1, wherein the traveling mechanism comprises a vehicle body, wherein a crawler-type traveling member is mounted at a bottom of the vehicle body, four corners of the vehicle body are rotatably connected with connection seats, each of the connection seats is hinged with one end of a supporting arm, and another end of the supporting arm is hinged with a first supporting plate; one end of a driving hydro-cylinder is hinged with the supporting arm, and another end of the driving hydro-cylinder is hinged with the connection seats.

10. The device according to claim 1, wherein the rod-changing robotic arm comprises a robotic arm body, a head end of the robotic arm body is connected with a slewing mechanism mounted on the traveling mechanism, and a tail end of the robotic arm body is provided with a clamping jaw mechanism for clamping and fixing the drilling tool.

* * * * *